United States Patent [19]

Schwander et al.

[11] 4,259,265

[45] Mar. 31, 1981

[54] CARBURETOR FOR INTERNAL COMBUSTION ENGINES

[75] Inventors: Dieter Schwander, Ratingen; Bernd Findeisen, Dusseldorf, both of Fed. Rep. of Germany

[73] Assignee: Pierburg GmbH & Co. KG, Neuss, Fed. Rep. of Germany

[21] Appl. No.: 70,694

[22] Filed: Aug. 28, 1979

[30] Foreign Application Priority Data

Sep. 27, 1978 [DE] Fed. Rep. of Germany ... 2841916

[51] Int. Cl.[3] ..... F02M 3/08

[52] U.S. Cl. ..... 261/41 D

[58] Field of Search ..... 261/41 D

[56] References Cited

U.S. PATENT DOCUMENTS

| | | | |
|---|---|---|---|
| 1,809,387 | 6/1931 | Melkman | 261/41 D |
| 1,872,559 | 8/1932 | Bicknell | 261/41 D |
| 2,137,665 | 11/1938 | Crockett | 261/41 D |
| 2,568,987 | 9/1951 | Brunn | 261/41 D |
| 2,689,115 | 9/1954 | Olson | 261/41 D |
| 3,167,599 | 1/1965 | Brown et al. | 261/41 D |
| 3,554,173 | 1/1971 | Masaki et al. | 261/DIG. 19 |

FOREIGN PATENT DOCUMENTS

| | | | |
|---|---|---|---|
| 1928532 | 3/1970 | Fed. Rep. of Germany | 261/41 D |
| 1966970 | 2/1976 | Fed. Rep. of Germany | 261/41 D |
| 1246560 | 9/1971 | United Kingdom | 261/41 D |

*Primary Examiner*—Tim R. Miles

*Attorney, Agent, or Firm*—Haseltine and Lake

[57] ABSTRACT

A carburetor for internal combustion engines with a fuel-carrying main injection system discharging upstream from an arbitrarily actuated main throttle into the intake duct. An idling mixture duct discharges downstream of this main throttle via an arbitrarily adjustable throttle cross section. From the idling mixture duct, a transition opening leads to the intake duct whose exit cross section upon opening the main throttle away from the idling position shifts from the intake duct section upstream of the main throttle to the downstream section. An auxiliary duct for adding further mixture connects the idling duct with the exit opening. The cross section of the auxiliary duct is regulated by a screw and the auxiliary duct has a ball retaining valve.

1 Claim, 1 Drawing Figure

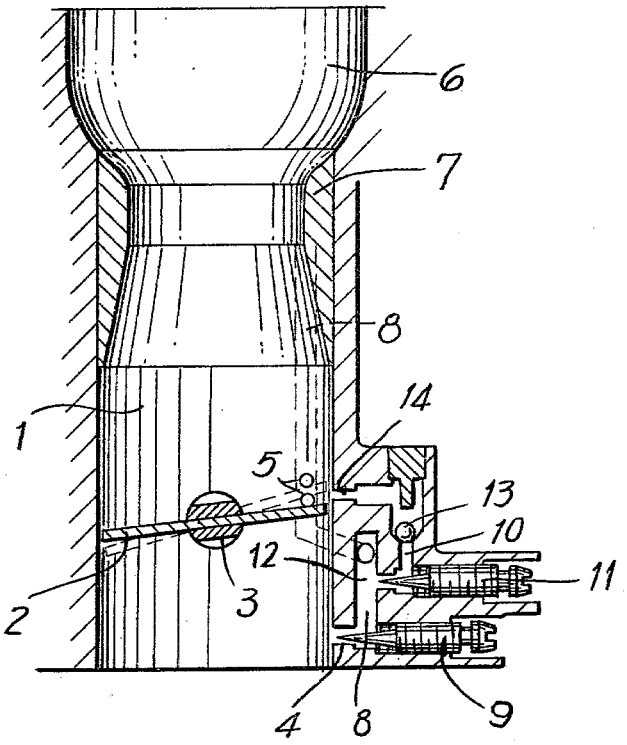
6
7
8
14
1
5
13
10
12
11
2
3
4
8
9

CARBURETOR FOR INTERNAL COMBUSTION ENGINES

BACKGROUND OF THE INVENTION

The present invention relates to a carburetor for internal combustion engines with a fuel-carrying main injection system which discharges upstream from an arbitrarily actuated main throttle into the intake duct, and an idling mixture duct discharging downstream of this main throttle via an arbitrarily adjustable throttle cross section. From this idling mixture duct, a transit opening leads into the intake duct whose exit cross section upon opening the main throttle away from the idling position shifts from the intake duct section upstream of the main throttle to the section downstream of the main throttle. There is an auxiliary channel discharging into this region to add another amount of air-fuel mixture.

A carburetor with an idling duct transition opening whose cross section can be regulated is known from German Utility Pat. 19 66 970 published Feb. 26, 1976. This transition opening causes an additional mixture supply when changing from idling to slow speed, to obtain a perfect running of the internal combustion engine also for slow speed, without increasing the mixture supply during idling in a manner prohibited by the exhaust gas regulations. However, this known carburetor system does not permit independent adjustment of the mixture for idling and for slow speed. This means that every change in adjustment for one mode of operation results in a change of setting for the other mode of operation since the flow direction in the transition holes reverses when shifting from one mode to the other. In order to remedy this difficulty, the German Patent Specification 19 28 532 dated Aug. 12, 1968, provided an auxiliary system which has an arbitrarily adjusted air duct discharging in the region of the transition openings. Futhermore, a mixtureforming independent duct system with adjustment facilities was provided with the exit again in the region of the transition holes. This solves the problem of independent adjustment, but difficulties of another type arise. The proposal with the air duct has the disadvantage that the duct must have a rather large cross section in order to provide an effective intervention. Because of the space restrictions on a carburetor, design difficulties arise. Besides space requirement for several and partly long ducts, the additional duct system for mixture forming has the disadvantage that it is expensive to manufacture.

Accordingly, it is an object of the present invention to provide a carburetor which makes possible an independent setting of the idling system and of a transition system and which can be produced with a reduced space requirement and low expenditure.

Another obejct of the present invention is to provide a carburetor of the foregoing character which is substantially simple in construction and may be economically fabricated.

The further object of the present invention is to provide a carburetor, as described, which may be readily maintained in service and which has a substantially long operating life.

SUMMARY OF THE INVENTION

The objects of the present invention are achieved by a carburetor of the type mentioned above by having the auxiliary duct connect the idling duct upstream of the idling mixture regulator screw to the exit opening, with the auxiliary duct having a cross section regulated by a screw and a ball retaining valve.

By placing the ball retaining valve in the auxiliary duct, a reaction of the transition hole of the variable cross section of the idling system to engage in the idling mode is prevented when the transition openings are upstream of the main throttle and feed air into the idling system.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

A sectional elevational view showing an embodiment according to the present invention.

DESCRIPTION OF THE PREFERRED EMBODIMENTS

The carburetor may be of any known design and contains, besides the main injection system (not shown) which discharges into the mixture duct 1 upstream of a main throttle 2, mounted on shaft 3. It further contains an idling mixture system which discharges into the mixture duct 1 upstream of a main throttle 2 mounted on shaft 3, an idling mixture system which discharges in duct 1 via an idling opening 4 which is always downstream of throttle 2. It also discharges through at least one transition opening 5 which is arranged in such a way that it passes from the upstream side of the throttle 2 to the downstream side when the throttle is moved from the position shown in the drawing by solid lines of smallest opening (idling position) to the slow-running position shown by broken lines.

The duct 1 has an air intake 6 with an air filter (not shown) and an air funnel 7 into whose narrowest cross section the main injection system (not shown) discharges. The idling system contains a duct 8 on which openings 4 and 5 are located, and which is connected upstream to the atmosphere or the air intake 6 and a fuel source (not shown), for example, the float chamber, to form an air-fuel mixture. The idling opening 4 has adjusting devices, for example, a screw 9 with a cone-shaped shank. The openings 5 are arranged in such a way that they successively pass to the downstream side, depending on the opening of throttle 2.

The mixture flow can be adjusted during idling by means of screw 9. If the throttle 2 is moved from the idling position into the transition position shown by the broken line, it must be possible to readjust the mixture. This is made possible by an auxiliary duct 10 upstream of the idling mixture regulating screw 9. This duct receives mixture from the idling mixture duct 8 via an opening 12 whose flow is regulated via a screw 11 and delivers it via a ball retaining valve 13 to exit opening 14.

By adjusting the free cross section of hole 12 by means of screw 11 it is possible to regulate the composition of the overall mixture supplied during the slow-speed phase to duct 1.

The ball retaining valve 13 prevents air from being fed via the variable cross section of opening 12 to the idling duct.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. A carburetor for internal combustion engines comprising: a fuel-carrying main injection system, a main throttle, an intake duct, said main injection system discharging into said intake duct upsteam of said main throttle, said main throttle being arbitrarily actuated; an idling mixture duct discharging downstream of said main throttle via an arbitrarily adjustable cross section; at least one transition opening leading from said idling mixture duct to said intake duct; said intake duct having an exit cross section shifting upon opening of said main throttle out of idling position from an upstream section of said intake duct to downstream section; an auxiliary duct discharging into said downstream section for adding further mixture; an idling regulating screw; said auxiliary duct connecting said idling mixture duct upstream of said idling regulation screw to an exit opening; adjusting screw means for regulating the cross section of said auxiliary duct; and a ball retaining valve in said auxiliary duct, so that an idling mixture may be adjusted independently of a transition mixture.

* * * * *